US005120250A

United States Patent [19]

Patrician et al.

[11] Patent Number: 5,120,250

[45] Date of Patent: Jun. 9, 1992

[54] ELECTRODE FOR IGNITION PLUG

[75] Inventors: Thomas J. Patrician, Monroeton; William C. Fulkerson, Towanda; Harry D. Martin, III, Troy, all of Pa.

[73] Assignee: GTE Products Corporation, Stamford, Conn.

[21] Appl. No.: 814,531

[22] Filed: Dec. 30, 1991

Related U.S. Application Data

[62] Division of Ser. No. 603,090, Oct. 25, 1990.

[51] Int. Cl.[5] ..... H01J 9/14

[52] U.S. Cl. ..... 445/7; 445/50

[58] Field of Search ..... 445/7, 50, 49; 419/6

[56] References Cited

U.S. PATENT DOCUMENTS

| | | | |
|---|---|---|---|
| 2,261,436 | 11/1941 | Fanger et al. | 313/142 |
| 3,967,149 | 6/1976 | Eaton et al. | 445/7 X |
| 5,041,041 | 8/1991 | Passmore et al. | 445/50 X |

*Primary Examiner*—Kenneth J. Ramsey

*Attorney, Agent, or Firm*—James Theodosopoulos

[57] ABSTRACT

The center electrode of an ignition plug is a unitary cylindrical tungsten rod in which the outer peripheral portion thereof has a higher work function than the core portion.

3 Claims, 1 Drawing Sheet

ELECTRODE FOR IGNITION PLUG

This application is a division of application Ser. No. 07/603,090, filed Oct. 25, 1990.

This invention concerns ignition plugs, such as spark plugs and plasma jet ignition plugs, for igniting fuel. Such plugs generally comprise two spaced apart electrodes, usually a center electrode and a ground electrode, across which an electric arc discharge is drawn for ignition. Examples of spark plugs are shown in U.S. Pat. Nos. 4,926,088, 4,808,135, 4,725,254, 4,684,352, 4,606,730, 4,585,421, 4575,343, 4,374,450, 4,345,179 and 3,356,882. Examples of plasma jet ignition plugs are shown in U.S. Pat. Nos. 4,766,855, 4,760,820, 4,493,297, 4,487,192, 4,471,732, 4,396,855 and 4,337,408.

In the prior art, the arc occurs anywhere on the end face of the center rod electrode, including the peripheral edge thereof. When the arc occurs at the edge, the electrode is more subject to erosion than when the arc is kept away from the edge. It is a purpose of this invention to provide an electrode that keeps the arc away from the edge.

An ignition plug in accordance with this invention comprises a ground electrode and a center electrode supported in an electrically insulating ceramic body. The center electrode is a unitary cylindrical tungsten rod or wire in which the outer peripheral portion has a higher work function than the core portion. The higher work function outer portion effectively keeps the arc away therefom, confining the arc to the lower work function core portion.

In the drawing, FIG. 1 is a diagram of a prior art plug showing the region over which the arc can occur.

Figure 1:
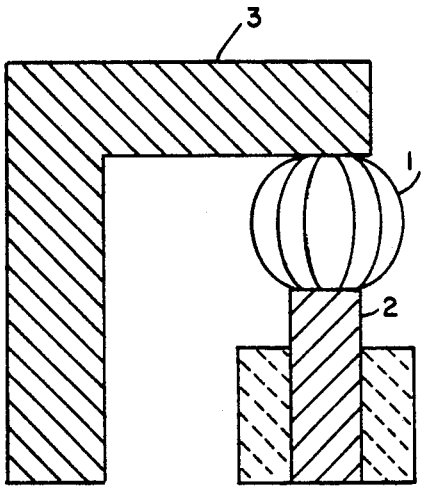
Figure 2:
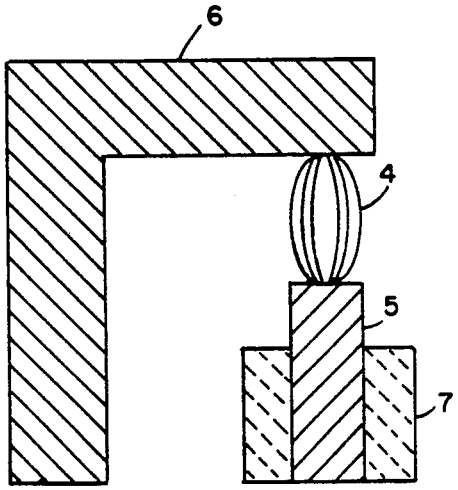
FIG. 2 shows a plug in accordance with this invention, showing the arc confined to the core portion of the center electrode, away from the peripheral edge thereof.
Figure 3:
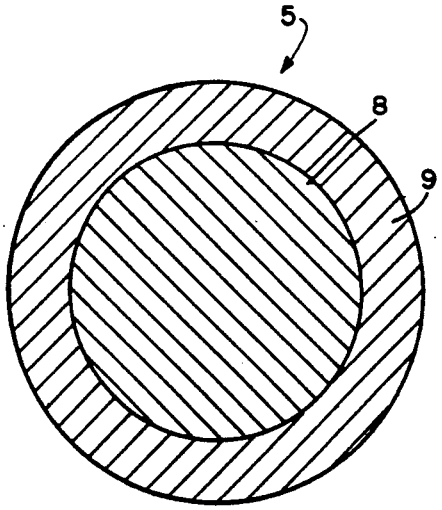
FIG. 3 is a cross sectional view of an ignition plug in accordance with this invention.

In the prior art, as shown in FIG. 1, arc discharge 1 between center electrode 2 and ground electrode 3 could occur anywhere on the discharge end of center electrode 2.

In the instant invention, arc discharge 4 between center electrode 5 and ground electrode 6 is kept away from the outer peripheral portion of center electrode 5 because said outer peripheral portion has a higher work function than the core portion of center electrode 5. Electrodes 5 and 6 are supported in electrically insulating ceramic body 7.

In one embodiment, center electrode 5 was a wire 39 mils in diameter. Core portion 8, consisted of tungsten containing 2% thoria. The balance of the wire, which constituted outer peripheral portion 9, consisted of tungsten containing 1% thoria. The tungsten-2% thoria material has a lower work function than the tungsten-1% thoria material.

The wire for center electrode 5 was made as follows.

A cylindrical mold, 24" long by 1.82" inside diameter, was made of a compliant, e.g. rubbery, material of the type normally used in isostatic pressing. A thin metal cylindrical tube, 36" long by 1" diameter, was coaxially disposed in the cylindrical mold. The metal tube was partially filled with a blend of 98% tungsten-2% thoria powder. The rest of the mold was filled to the same height with a blend of 99% tungsten-1% thoria powder. The metal tube was then carefully removed to minimize any mixing of the powders. The mold was isostatically pressed at 40 ksi. After removal of the mold, the pressed ingot was sintered 12 hours at 2100° C. The density of the sintered ingot was 17.86 grams/cc. The ingot was then rolled, swaged and drawn, with annealing steps in-between, to wire 39 mils in diameter. There was little mixing or diffusing of the two powders and the 98% tungsten-2% thoria powder mixture occupied about the same diameter ratio in the final wire as in the mold. Thus, the diameter of the 98% tungsten-2% thoria core was about 21 mils.

Following are examples of other materials that could be used in accordance with this invention. With a peripheral portion consisting of pure tungsten, the core portion could comprise tungsten with 1% or 2% thoria, tungsten with 1% or 2% ceria, tungsten with 1% or 2% lanthana, tungsten with 1% or 2% zirconia. With a peripheral portion consisting of tungsten with 1% thoria, the core portion could comprise tungsten with 2% ceria or 2% lanthana.

We claim:

1. The method of making an ignition spark plug including the step of forming a composite wire electrode for said ignition plug by the steps comprising preparing a rubbery cylindrical mold; disposing a thin metal cylindrical tube coaxially in the compliant cylindrical mold, the thin metal cylindrical tube having a smaller diameter than the compliant cylindrical mold; partially filling the metal tube with a first powder suitable for ignition plug electrode use; filling the rest of the mold to the same height with a second powder suitable for ignition plug electrode use, the second powder having a higher work function than the first powder; carefully removing the metal tube to minimize mixing of the powders; isostatically pressing the mold to form an ingot; removing and sintering the ingot; rolling, swaging and drawing the ingot to form a wire suitable for use as an electrode for an ignition plug, the peripheral portion of the wire having a higher work function than the core portion of the wire.

2. The method of claim 1 wherein the second powder consists of pure tungsten and the first powder consists of one of tungsten with 1% or 2% thoria, tungsten with 1% or 2% ceria, tungsten with 1% or 2% thoria, tungsten with 1% or 2% ceria, tungsten with 1% or 2% lanthana, tungsten with 1% or 2% zirconia.

3. The method of claim 1 wherein the second powder consists of tungsten with 1% thoria and the first powder consists of one of tungsten with 2% ceria or tungsten with 2% lanthana.

* * * * *